US008986470B2

(12) United States Patent
Anada et al.

(10) Patent No.: US 8,986,470 B2
(45) Date of Patent: Mar. 24, 2015

(54) NICKEL MATERIAL FOR CHEMICAL PLANT

(75) Inventors: Hiroyuki Anada, Nishinomiya (JP); Junichi Higuchi, Nishinomiya (JP); Kiyoko Takeda, Nishinomiya (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 12/385,723

(22) Filed: Apr. 17, 2009

(65) Prior Publication Data

US 2009/0269238 A1 Oct. 29, 2009

Related U.S. Application Data

(63) Continuation of application No. PCT/JP2007/070351, filed on Oct. 18, 2007.

(30) Foreign Application Priority Data

Oct. 20, 2006 (JP) ..... 2006-285718

(51) Int. Cl.

| | |
|---|---|
| ***C22C 19/03*** | (2006.01) |
| ***C22F 1/10*** | (2006.01) |
| ***C22F 1/00*** | (2006.01) |

(Continued)

(52) U.S. Cl.

CPC . *C22F 1/10* (2013.01); *C22C 19/03* (2013.01); *C22F 1/00* (2013.01); *C21D 8/02* (2013.01); *C21D 8/10* (2013.01); *C21D 2211/004* (2013.01)

USPC ..... 148/423; 420/441

(58) Field of Classification Search

CPC ..... C22C 19/03

USPC ..... 148/423; 420/441

See application file for complete search history.

(56) References Cited

U.S. PATENT DOCUMENTS

| | | | | |
|---|---|---|---|---|
| 4,023,936 | A * | 5/1977 | Morse et al. | 428/679 |
| 6,440,293 | B2 * | 8/2002 | Morokuma et al. | 205/359 |

(Continued)

FOREIGN PATENT DOCUMENTS

| | | |
|---|---|---|
| JP | 36-14006 | 8/1936 |
| JP | 44-10654 | 5/1969 |

(Continued)

OTHER PUBLICATIONS

VDM LC-Nickel 99.2 (Unalloyed Wrought Nickel). Alloy Digest. 1996.*

(Continued)

*Primary Examiner* — Brian Walck
(74) *Attorney, Agent, or Firm* — Clark & Brody

(57) ABSTRACT

A nickel material, which comprises by mass percent, C: 0.003 to 0.20% and one or more elements selected from Ti, Nb, V and Ta: a total content less than 1.0%, the contents of these elements satisfying the relationship specified by the formula of "(12/48) Ti+(12/93) Nb+(12/51) V+(12/181) Ta—C≥0", with the balance being Ni and impurities, does not deteriorate in the mechanical properties and corrosion resistance even when it is used at a high temperature for a long time and/or it is affected by the heat affect on the occasion of welding. Therefore, it can be suitably used as a member for use in various chemical plants including facilities for producing caustic soda, vinyl chloride and so on. Each element symbol in the above formula represents the content by mass percent of the element concerned.

6 Claims, 2 Drawing Sheets

(51) Int. Cl.
*C21D 8/02* (2006.01)
*C21D 8/10* (2006.01)

(56) References Cited

U.S. PATENT DOCUMENTS

| | | | | |
|---|---|---|---|---|
| 2002/0155306 | A1* | 10/2002 | Anada et al. | 428/472.1 |
| 2004/0103963 | A1* | 6/2004 | Miyahara et al. | 148/675 |

FOREIGN PATENT DOCUMENTS

| | | | | |
|---|---|---|---|---|
| JP | 62-250141 | | 10/1987 | |
| JP | 63-168259 | | 7/1988 | |
| JP | 02-145333 | | 6/1990 | |
| JP | 02-236250 | | 9/1990 | |
| JP | 08-143996 | | 6/1996 | |
| JP | 2002060877 | A * | 2/2002 | C22C 19/03 |
| JP | 2006-057186 | | 3/2006 | |

OTHER PUBLICATIONS

Savitskiy et al. "Mechanical Properties of Vanadium-Alloyed Copper and Nickel—Vanadium Alloys at Elevated Temperatures." Metal Science and Heat Treatment. vol. 3, Nos. 3-4, 126-128. 1961.*

Murray et al. "Preparation and Characterization of Pure Metals." Properties and Selection: Nonferrous Alloys and Special-Purpose Materials, vol. 2, ASM Handbook, ASM International, p. 1093-1097. 1990.*

He et al. "The Corrosion Behavior of Ni—Nb Alloys in a Mixed Gas of H2—H2O—H2S." Oxidation of Metals, vol. 37, Nos. 3/4, 1992. pp. 217-252.*

* cited by examiner

NICKEL MATERIAL FOR CHEMICAL PLANT

This application is a continuation of International Patent Application No. PCT/JP2007/070351, filed Oct. 18, 2007. This PCT application was not in English as published under PCT Article 21(2).

TECHNICAL FIELD

The present invention relates to a nickel material for a chemical plant. More particularly, the present invention relates to a nickel material for a chemical plant which can be suitably used as a structural member and the like for use in a plant where corrosive substances are dealt with such as the chemical industry.

BACKGROUND ART

Nickel particularly has an excellent corrosion resistance in alkali, and also has corrosion resistance even in a high-concentration chloride environment. Therefore, it has been used as a member for use in various chemical plants including facilities for producing caustic soda, vinyl chloride and so on.

The above-mentioned members include a seamless pipe, a welded pipe, a plate, an elbow and so on. In apparatus and devices used in the said facilities, a member made of nickel (hereinafter also referred to as a "nickel material") is often used in a welded state.

Carbon is contained as an impurity element in the nickel, however, the solubility limit of carbon in the nickel is low. Therefore, a long period of the use of nickel material at a high temperature may cause precipitation of carbon on the grain boundaries, or the welded nickel material may cause precipitation of carbon on the grain boundaries because of the heat affect on the occasion of welding; in both cases, the nickel material becomes brittle, therefore the mechanical properties and/or corrosion resistance thereof may be deteriorated.

Accordingly, in the JIS H 4552 (2000) for "Nickel and nickel alloy seamless pipes and tubes", the carbon content of the nickel material having an ordinary carbon level (alloy number: NW2200) is prescribed to be not more than 0.15%. On the other hand, the carbon content of the nickel material having a low carbon level (alloy number: NW2201) is prescribed to be not more than 0.02%. As mentioned above, in the fields of application involving use at a high temperature, the nickel material reduced in the carbon content from the ordinary level to a level of not more than 0.02% has been put to practical use.

However, even in the case of a nickel material in which the content of carbon has been reduced to a low level of not more than 0.02%, during a long period of use at a high temperature, carbon which is contained in the nickel as an impurity mainly precipitates on the grain boundaries, and thus the said precipitated carbon has a malignant influence on the corrosion resistance, mechanical properties and so on.

As for the nickel materials, for example, various techniques have been proposed in the Patent Documents 1 to 4.

That is to say, the Patent Document 1 discloses an "improved nickel anode" for the use of nickel plating, which contains 0.1 to 0.5% of carbon and 0.1 to 1% of titanium in pure Ni. According to this technique, as the result of the addition of titanium, which has a strong affinity for carbon, the said titanium reacts with carbon during the dissolution of the anode in the plating solutions, and a thin film of TiC is formed. The said thin TiC film inhibits nickel particles from disintegrating and falling, whereby fine and shiny plating can be attained.

The Patent Document 2 discloses a "Ni alloy having high hardness and low contact electric resistance" which contains, on a weight percent basis, C: 0.05 to 0.3% and Mo: not more than 8% and/or Nb: not more than 5.5% provided that 3.1×Nb+Mo is 7 to 17%. In this Patent Document, it is mentioned that the Nb precipitates as Nb carbides, and the said carbides harden Ni.

The Patent Document 3 discloses a "Ni base alloy for boronizing treatment" which contains at least one element selected from Ti, Nb, Si, Zr, Hf, Mo and Ta in respectively specified amounts. The said ally is to be subjected to boronizing treatment in order to form a very hard boride layer.

Further, the Patent Document 4 discloses a "high-purity nickel core wire for inert gas shielded arc welding" which has the composition of Ni≥99%, C≤0.02%, Ti+Al: 0.1 to 1.0% and O (oxygen)≤0.002% in order to prevent the occurrence of weld defects such as cracks and blow holes.

Patent Document 1: Japanese Examined Patent Publication No. 36-14006

Patent Document 2: Japanese Unexamined Patent Publication No. 02-236250

Patent Document 3: Japanese Unexamined Patent Publication No. 62-250141

Patent Document 4: Japanese Examined Patent Publication No. 44-10654

DISCLOSURE OF THE INVENTION

Problems to be Solved by the Invention

As mentioned above, the Patent Documents 1 and 2 describe the addition of Ti and/or Nb for precipitation of carbon as carbides thereof. In both cases, however, no attention is paid to the deterioration of the mechanical properties and corrosion resistance which are caused by grain boundary precipitation of the carbon contained in the Ni. As a result, the techniques disclosed in the Patent Documents 1 and 2 can not always prevent the impairment of the mechanical properties and/or the deterioration of corrosion resistance resulting from grain boundary precipitation of carbon during a long period of use at a high temperature, or from grain boundary precipitation of carbon due to heat affect on the occasion of welding.

The techniques disclosed in the Patent Documents 3 and 4, like the techniques disclosed in the above Patent Documents 1 and 2, also pay no attention to the deteriorations of mechanical properties and corrosion resistance due to grain boundary precipitation of the carbon contained in the Ni. Therefore, the techniques disclosed in the Patent Documents 3 and 4 also can not always prevent the impairment of the mechanical properties and/or the deterioration of corrosion resistance resulting from grain boundary precipitation of carbon during a long period of use at a high temperature, or from grain boundary precipitation of carbon due to heat affect on the occasion of welding.

Accordingly, an objective of the present invention is to provide a nickel material for a chemical plant which will not cause deterioration of mechanical properties and/or corrosion resistance even after a prolonged period of use at a high temperature, or under heat affect on the occasion of welding, and which can be suitably used as a member for use in various chemical plants including facilities for producing caustic soda, vinyl chloride and so on.

Means for Solving the Problems

The present inventors made various investigations in order to accomplish the above objective and, as a result, obtained the following findings (a) to (c).

(a) Ti, Nb, V and Ta are elements which form thermodynamically stable carbides, and have a stronger affinity for carbon as compared with Ni and precipitate as carbides. If these carbides precipitate within grains, the amount of carbon dissolved in the Ni decreases, and therefore, the amount of carbon, which precipitates on the grain boundaries due to a long period of use at a high temperature or heat affect on the occasion of welding, decreases.

(b) Even if carbides such as TiC and so on are finely dispersed within the grains, they do not have a malignant influence on the corrosion resistance and mechanical properties. Therefore, if Ti, Nb, V and Ta precipitate as carbides within the grains, the amount of carbon which precipitates on the grain boundaries decreases, and consequently, the deterioration of the corrosion resistance and mechanical properties can be prevented.

(c) The above-mentioned carbides of Ti, Nb, V and Ta precipitate in the high temperature region on the occasion of melting and solidification in the production process, and therefore the precipitation sites thereof are, in many cases on the grain boundaries. However, when the carbon content is restricted together with the total content of one or more elements selected from Ti, Nb, V and Ta, and further, the content of carbon and the contents of the said Ti, Nb, V and Ta are in a certain specific relationship, the amount of carbon dissolved in the Ni decreases by an amount corresponding to the precipitation thereof as carbides and, in addition, the said carbides that have precipitated on the grain boundaries in a high temperature region on the occasion of melting and solidification are repeatedly subjected to crystal deformation and recrystallization in the steps of hot working, cold working and heat treatment after solidification in the process for the production of a nickel material, so that the said carbides become finely dispersed within grains. Furthermore, as the precipitation of the carbides of Ti, Nb and so on refines grain size; the effect of improving the mechanical properties also can be expected.

The present invention has been accomplished on the basis of the above-described findings. The main point of the present invention is a nickel material for a chemical plant shown in the following.

A nickel material for a chemical plant, which comprises by mass percent, C: 0.003 to 0.20% and one or more elements selected from Ti, Nb, V and Ta: a total content less than 1.0%, the contents of these elements satisfying the relationship specified by the following formula (1), with the balance being Ni and impurities:

$$(12/48)Ti+(12/93)Nb+(12/51)V+(12/181)Ta—C\geq 0 \quad (1);$$

In the formula (1), each element symbol represents the content by mass percent of the element concerned.

Effects of the Invention

The nickel material for a chemical plant of the present invention contains one or more elements selected from Ti, Nb, V and Ta, having a stronger affinity for carbon as compared with nickel and the contents thereof are in the said specified relationship with the content of carbon. Moreover, the said nickel material has the carbon content as low as 0.003 to 0.20%. Therefore, the amount of carbon which precipitates on the grain boundaries is markedly reduced, so that the deterioration of corrosion resistance and mechanical properties can be prevented. Consequently, the said nickel material will be hardly deteriorated in mechanical properties and corrosion resistance even when it is used at a high temperature for a long time and/or it is affected by the heat affect on the occasion of welding. Therefore, it can be suitably used as a member for use in various chemical plants including facilities for producing caustic soda, vinyl chloride and so on.

BEST MODES FOR CARRYING OUT THE INVENTION

Figure 1:
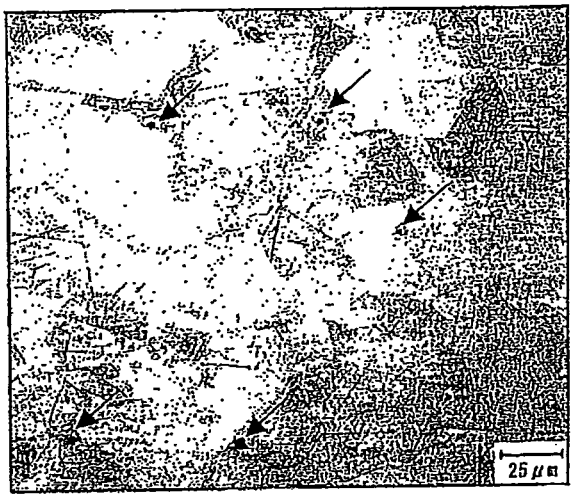
FIG. 1 is a representation of an observation by an optical microscope. Concretely, it shows the grain boundaries where no carbon precipitates exist and also shows the TiC precipitations which exist within the grains in the alloy No. 5, which is taken as an inventive example of the nickel material whose chemical compositions fall within the range regulated by the present invention. Each arrow in the figure indicates TiC.

In the following, all of the requirements of the present invention are described in detail. In the following description, the symbol "%" for the content of each element represents "% by mass".

C: 0.003 to 0.20%

When the C content is a small one, that is to say, the content of C is less than 0.003%, the problem of the grain boundary precipitation of carbon, which is caused by a long period of use at a high temperature, or heat affect on the occasion of welding and affects the corrosion resistance and mechanical properties, does not occur. Accordingly, the lower limit of C is set to 0.003%. On the other hand, when the content of C exceeds 0.20%, the said grain boundary precipitation of carbon cannot be avoided, resulting in the deterioration of corrosion resistance and mechanical properties, even when carbon is fixed within the grains as carbides by adding Ti and so on. Therefore, the content of C is set to 0.003 to 0.20%. When more severe environments are taken into consideration, the upper limit content of C is preferably 0.10%. Further more preferably, the content of C is less than 0.05%.

One or more elements selected from Ti, Nb, V and Ta: a total content less than 1.0% provided that the contents of these elements should satisfy the relationship specified by the said formula (1)

Ti, Nb, V and Ta have a stronger affinity for carbon as compared with Ni. They combine with carbon, which is contained in the Ni, and form carbides in the process for the production of a nickel member.

When the total content of one or more elements selected from Ti, Nb, V and Ta is less than 1.0% and the respective contents thereof, in relation to the content of C, satisfy the relationship specified by the said formula (1), that is to say, the formula "(12/48) Ti+(12/93) Nb+(12/51) V+(12/181) Ta—C≥0", the amount of carbon dissolved in the Ni decreases and, in addition, the carbides that have precipitated on the grain boundaries in a high temperature region on the occasion of melting and solidification are repeatedly subjected to crystal deformation and recrystallization in the steps of hot working, cold working and heat treatment after solidification in the process for the production of a nickel material, so that the carbides become finely dispersed within the grain. Since the carbides finely dispersed within a grain do not have a malignant influence on the corrosion resistance and mechanical properties, the deterioration of corrosion resistance and mechanical properties can be prevented. Furthermore, as the precipitation of carbides of Ti, Nb and so on refines grain size; the effect of improving the mechanical properties also can be expected.

The lower limit of the total content of one or more elements selected from Ti, Nb, V and Ta is determined by the amount of carbon which is contained in the Ni and the morphology of the said carbides and corresponds to the amount resulting from consideration of the ratios of the amount of carbon contained in the Ni and the contents of the respective alloying elements contained in the carbides, together with the content of the dissolved carbon, that is to say, an amount which satisfies the relationship specified by the said formula (1).

The upper limit of the total content of one or more elements selected from Ti, Nb, V and Ta may be within such a range that the corrosion resistance and mechanical properties, such as strength and toughness may not be adversely affected in relation to the carbon content. However, when the content is excessive, the strength becomes too high, which causes not only the deterioration of workability but also the deterioration of corrosion resistance. Therefore, the total content of one or more elements selected from Ti, Nb, V and Ta is set to less than 1.0%.

The total content of one or more elements selected from Ti, Nb, V and Ta is preferably not more than 0.8%.

From the reasons mentioned above, the nickel material for a chemical plant according to the present invention is defined as the one comprising by mass percent, C: 0.003 to 0.20% and one or more elements selected from Ti, Nb, V and Ta: a total content less than 1.0%, the contents of these elements satisfying the relationship specified by the said formula (1), with the balance being Ni and impurities.

The nickel material for a chemical plant, which has a particularly excellent corrosion resistance in alkali and also has a corrosion resistance even in a high concentrated chloride environment, preferably has a Ni content of not less than 98%. In the said case, the content of Ni is more preferably not less than 98.5% and further more preferably not less than 99%.

In order to prevent the deterioration of corrosion resistance and workability, the contents of impurities are preferably as follows; Cu: not more than 0.2%, Mn: not more than 0.3%, Fe: not more than 0.4%, Si: not more than 0.3% and S: not more than 0.01%. The total content of impurities is preferably less than 1.0% and more preferably less than 0.5%.

The nickel material of the present invention, for instance, can be produced by melting, using an electric furnace, an AOD furnace, a VOD furnace, a VIM furnace and so on.

Next, a slab, a bloom or a billet is produced by casting the molten metal, which is prepared by a melting process, into an ingot by the so-called "ingot making method" and subjecting the ingot to hot working, or by continuous casting. Then, in the case of pipe manufacturing, for instance, any of such raw materials is subjected to hot working into a tubular product by the hot extrusion pipe manufacturing process or Mannesmann pipe manufacturing process. Or, in the case of plate manufacturing, for example, the said raw material is subjected to hot rolling into a plate or a coil shaped sheet.

That is to say, the hot working may use any hot working process. For example, in a case where the final product is a tubular one, the hot working may include the hot extrusion pipe manufacturing process represented by the Ugine-Sejournet process, and/or the rolling pipe manufacturing process (Mannesmann pipe manufacturing process) represented by the Mannesmann-Plug Mill rolling process or the Mannesmann-Mandrel Mill rolling process or the like. In a case where the final product is a plate or a sheet, the hot working may include the typical process of manufacturing a plate or a sheet in coil.

It is recommended that the heating temperature before the hot forging or the hot rolling be within the range of 900 to 1200° C. As Ni is rather soft, the said heating temperature is more preferably within the range of 900 to 1100° C. An excellent hot workability can be obtained, under such temperature conditions, so that it becomes possible to prevent the occurrence of a cracking during hot forging or, of an edge crack or a surface flaw during hot rolling.

The end temperature of the hot working is not particularly defined, but may be set to not less than 750° C. This is because if the hot working end temperature is less than 750° C., the deterioration of hot workability arises and the ductility is impaired.

The cold working may be carried out after the hot working. For instance, in a case where the final product is a tubular one, the cold working may include the cold drawing pipe manufacturing process in which the raw pipe produced by the above-mentioned hot working is subjected to drawing and/or the cold rolling pipe manufacturing process by the cold Pilger Mill. In a case where the final product is a sheet, the cold working may include the typical process of manufacturing a cold rolled sheet in coil.

Prior to the cold working mentioned above, in order to soften the material, the homogenizing treatment may be carried out. The heating temperature in the said homogenizing treatment is preferably within the range of 900 to 1200° C.

In order to anneal the material, the above-mentioned hot working or the above-mentioned cold working following the hot working is generally followed by the softening heat treatment, as a final heat treatment, which comprises heating and maintaining at 750 to 1100° C. and then rapidly cooling with water or air.

The said softening heat treatment is carried out not only for strength reduction but also for promoting the fixation of carbon within a grain as a result of the precipitation of such carbides as TiC and NbC. However, grain growth may possibly occur at a high temperature. Therefore, the annealing temperature is to be selected considering the balance with the strength. The said temperature is preferably set to the range of 750 to 950° C.

The following examples illustrate the present invention more specifically. These examples are, however, by no means limited to the scope of the present invention.

EXAMPLE

The nickel materials alloy Nos. 1 to 10, having the chemical compositions shown in Table 1, were melted by use of a vacuum melting furnace of a volume of 25 kg and made into ingots.

The alloys Nos. 1 to 8 are nickel materials having chemical compositions fall within the range regulated by the present invention. On the other hand, the alloys No. 9 and No. 10 are nickel materials of comparative examples whose chemical compositions are out of the range regulated by the present invention.

TABLE 1

| Classification | Alloy No. | Chemical compositions (% by mass) Balance: Ni and impurities C | Ti | Nb | Left side of formula (1) | Carbon precipitation on the grain boundaries |
|---|---|---|---|---|---|---|
| Inventive example | 1 | 0.016 | 0.08 | — | 0.0040 | precipitation-free |
| | 2 | 0.015 | 0.31 | — | 0.0625 | precipitation-free |
| | 3 | 0.016 | — | 0.15 | 0.0034 | precipitation-free |
| | 4 | 0.014 | — | 0.60 | 0.0634 | precipitation-free |
| | 5 | 0.08 | 0.60 | — | 0.0700 | precipitation-free |
| | 6 | 0.09 | — | 0.80 | 0.0132 | precipitation-free |
| | 7 | 0.11 | 0.34 | 0.30 | 0.0137 | precipitation-free |
| | 8 | 0.164 | 0.71 | — | 0.0135 | precipitation-free |
| Comparative example | 9 | * 0.30 | 0.50 | — | −0.1750 | precipitation-existing |
| | 10 | 0.01 | * — | * — | −0.0100 | precipitation-existing |

Left side of formula (1): (12/48)Ti + (12/93)Nb + (12/51)V + (12/181)Ta − C
The mark * indicates falling outside the conditions regulated by the present invention.

The ingots of the alloys Nos. 1 to 10 were processed into 4.5 mm thick plate nickel materials by a hot forging, a homogenizing heat treatment comprising heating to 1100° C. and maintaining at that temperature for 5 hours and then allowing to cool in air, a cold rolling, a softening heat treatment comprising heating to 800° C. and maintaining at that temperature for 5 minutes and then cooling with water, and the subsequent surface descaling.

The thus obtained 4.5 mm thick nickel materials were subjected to hours of sensitizing heat treatment at 600° C. Samples for microstructure observation, which were cut out from the said sensitized materials, were subjected to polishing and 10 to 300 seconds of electrolytic etching in Etchant 13 (10 g oxalic acid+100 mL water) described in ASTM E 407 at a voltage of 2 to 4 V, and then examined by an optical microscope to verify whether the carbon which precipitates on the grain boundaries exists or not. In view of the fact that the said carbon which precipitates on the grain boundaries is very fine, detailed investigations using thin film samples by a transmission electron microscope were simultaneously carried out.

The examination results of carbon precipitation on the grain boundaries are also shown in Table 1.

As is apparent from Table 1, TiC and/or NbC were observed within a grain and no carbon which precipitated on the grain boundaries was observed in the case of the nickel material made of the alloys Nos. 1 to 8 according to the present invention which contain one or both of Ti and Nb and satisfy the relationship specified by the formula (1) given hereinabove.

In FIG. 1, the observation result by an optical microscope of the alloy No. 5 which is taken as an inventive example of the nickel material whose chemical compositions fall within the range regulated by the present invention is shown. As is also apparent from FIG. 1, a lot of TiC precipitates, which are indicated by the arrows in the figure, are found within the grains and no carbon which precipitated on the grain boundaries are observed in the case of the nickel material whose chemical compositions fall within the range regulated by the present invention.

On the contrary, it can be seen that carbon which precipitated on the grain boundaries is found in the case of the nickel material made of the alloy No. 10 which contains neither Ti nor Nb and fails to satisfy the relationship by the said formula (1) and in the case of the nickel material made of the ally No. 9 which contains C in an amount outside the range regulated by the present invention and fails to satisfy the relationship by the formula (1). Consequently, their corrosion resistance and mechanical properties are deteriorated.

Figure 2A:
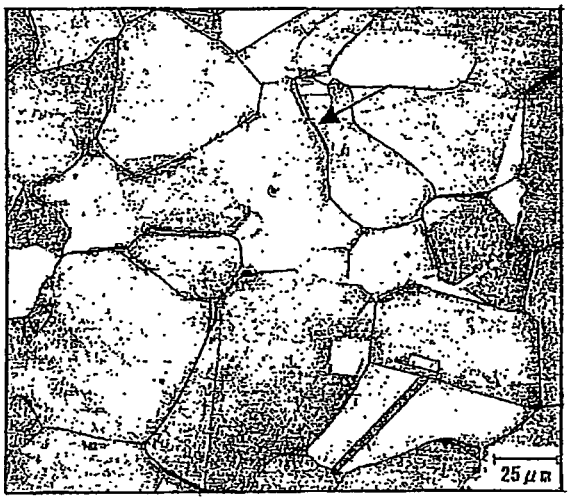
FIGS. 2(*a*) and 2(*b*) are representations of an observation by an optical microscope and by a transmission electron microscope, respectively. Concretely, they show the carbon which precipitated on the grain boundaries in the alloy No. 10, which is taken as a comparative example of the nickel material whose chemical compositions fall outside the range regulated by the present invention. Each arrow in the figures indicates carbon which precipitated on the grain boundaries.
Figure 2B:
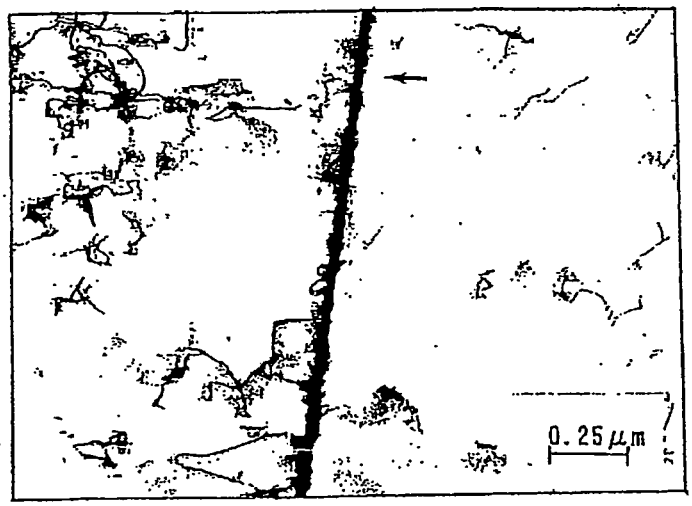

In FIGS. 2(*a*) and 2(*b*), the observation results by an optical microscope and by a transmission electron scope of the alloy No. 10 which is taken as a comparative example of the nickel material whose chemical compositions fall outside the range regulated by the present invention is shown. FIG. 2(*a*) shows the optical microscope observation result, and FIG. 2(*b*) shows the transmission electron microscope observation result. Each arrow in FIGS. 2(*a*) and 2(*b*) indicates carbon which precipitated on the grain boundaries. From FIGS. 2(*a*) and 2(*b*), in the case of the nickel material whose chemical compositions fall outside the range regulated by the present invention, carbon which precipitated on the grain boundaries was apparently found.

INDUSTRIAL APPLICABILITY

The nickel material for a chemical plant of the present invention contains one or more elements selected from Ti, Nb, V and Ta, having a stronger affinity for carbon as compared with nickel and the contents thereof are in the said specified relationship with the content of carbon. Moreover, the said nickel material has the carbon content as low as 0.003 to 0.20%. Therefore, the amount of carbon which precipitates on the grain boundaries is markedly reduced, so that the deterioration of corrosion resistance and the mechanical properties can be prevented. Consequently, the said nickel material does not deteriorate in the mechanical properties and the corrosion resistance even when it is used at a high temperature for a long time and/or it is affected by the heat affect on the occasion of welding. Therefore, it can be suitably used as a member for use in various chemical plants including facilities for producing caustic soda, vinyl chloride and so on.

What is claimed is:

1. A chemical plant structural member having no carbon precipitation on grain boundaries thereof, and made from a nickel material which comprises by mass percent, C: 0.003 to 0.20%, Ni: not less than 98% and Nb less than 1.0%, the contents of these elements satisfying the relationship specified by the following formula (1), with the balance being impurities:

$$(12/93)Nb—C\geq 0 \quad (1);$$

wherein each element symbol in the formula (1) represents the content by mass percent of the element concerned, wherein the nickel material has been hot worked and further wherein the nickel material includes an exposed outer surface capable of being welded for joining purposes.

2. The chemical plant structural member of claim 1, wherein the chemical plant structural member is selected from the group consisting of a pipe, a plate, a sheet, a welded member, and an elbow.

3. The chemical plant structural member of claim 1, wherein the chemical structural member is a pipe.

4. The chemical plant structural member of claim 1, wherein the chemical plant structural member is selected from the group consisting of a pipe, a welded member, and an elbow.

5. The chemical plant structural member of claim 1, wherein the content of Nb is not more than 0.8%.

6. The chemical plant structural member of claim 1, wherein the chemical plate structural member is used in alkali and high-concentration chloride environment.

* * * * *